United States Patent [19]

Baker

[11] 3,953,316

[45] Apr. 27, 1976

[54] METAL ANODE ASSEMBLY

[75] Inventor: Joseph E. Baker, Clearwater, Fla.

[73] Assignee: Olin Corporation, New Haven, Conn.

[22] Filed: Nov. 5, 1973

[21] Appl. No.: 412,936

[52] U.S. Cl. ..... 204/288; 204/250; 204/251; 204/286; 204/290 F

[51] Int. Cl.[2] ..... C25B 9/02; C25B 11/02; C25B 11/10

[58] Field of Search ..... 204/290 F, 250, 251, 204/286, 288, 290 R

[56] References Cited

UNITED STATES PATENTS

| | | | |
|---|---|---|---|
| 3,297,561 | 1/1967 | Harrison et al. | 204/286 |
| 3,409,533 | 11/1968 | Murayama et al. | 204/250 X |
| 3,507,771 | 4/1970 | Douges et al. | 204/284 |
| 3,598,715 | 8/1971 | Goens et al. | 204/278 |
| 3,607,416 | 9/1971 | Sizer et al. | 136/86 |
| 3,654,121 | 4/1972 | Keith et al. | 204/290 F |
| 3,663,280 | 5/1972 | Lee | 117/217 |
| 3,676,325 | 7/1972 | Smith et al. | 204/288 |
| 3,689,384 | 9/1972 | Barbato et al. | 204/99 |
| 3,839,179 | 10/1974 | Koziol et al. | 204/290 F |

*Primary Examiner*—F. C. Edmundson
*Attorney, Agent, or Firm*—Donald F. Clements; T. P. O'Day; J. B. Haglind

[57] ABSTRACT

An improved metal anode assembly formed as an integral titanium casting which is comprised of a spider-like distributor having an anodic surface secured to the bottom thereof. At least one anode post receiver is formed in the top of the distributor. The active face of the anodic surface is coated with at least one oxide of a platinum group metal. Utilizing cast titanium to form the distributor, the anode post receiver and the anodic surface of the metal anode assembly of this invention simplifies fabrication of the metal anode assembly and improves the durability and stability of the metal anode assembly.

6 Claims, 2 Drawing Figures

METAL ANODE ASSEMBLY

This invention relates to an improved metal anode assembly. More particularly it relates to a metal anode assembly of simplified construction and improved stability and durability.

In the operation of electrolytic cells employing a mercury amalgam cathode in the production of chlorine, numerous attempts have been made recently to replace conventional graphite anodes with metal anodes of various designs and compositions. Generally, these metal anode designs include a distributor having at least one anode post secured to the top thereof for supplying an electric current to the distributor. The distributor is generally in the form of an inverted channel having a web with two legs extending downwardly therefrom. A foraminous anodic surface is secured to the bottom of the two legs of the distributor, and spaced apart from the distributor surface. Current fed through the anode post to the distributor is conveyed across the distributor web to the exterior legs thereof and then is transmitted to the foraminous anodic surface. The foraminous anodic surface is generally a resistant metal base such as titanium, niobium, tantalum or zirconium, which is coated with at least one oxide of a platinum metal such as ruthenium, platinum, iridium, rhodium, palladium and osmium and mixtures thereof. Materials of construction useful as a base metal and as an oxide coating are described by Henri Bernard Beer in U.S. Pat. No. 3,236,756, issued Feb. 22, 1966, U.S. Pat. No. 3,265,526, issued Aug. 16, 1966, U.S. Pat. No. 3,632,498, issued Jan. 4, 1972 and U.S. Pat. No. 3,711,385, issued Jan. 16, 1973.

Metal anodes of this type are generally more stable under electrolytic conditions than conventional graphite anodes. However, there is still a need to improve the design of metal anodes to improve cell operation. For example, in some metal anodes such as those using screens, expanded metal or rods perpendicular to the direction of the flow of brine, a substantial portion of the anodic surface produces gas bubbles which are protected from direct contact with the flowing brine, and as a result, gas bubbles are not rapidly swept from the anodic surface. A collection of gas bubbles on any substantial portion of the anodic surface in metal anode designs such as this, markedly increases the current density, and therefore increase the cost of cell operation.

In addition, some previously known metal anode designs have anode structures which are difficult to uniformly coat with an oxide of a platinum group metal. Furthermore, some metal anode designs frequently result in warped anodic surfaces because they lack sufficient rigidity to resist deformation caused by accidents during handling, packaging and shipping. In addition, certain titanium alloys have a "memory" which causes bent plates or rods of these titanium alloys to return to their original configuration when subjected to elevated temperatures, such as temperatures which may occur during electrolytic cell operation.

There is a need at the present time for a metal anode design that will overcome the disadvantages present in previously known metal anode designs.

It is a primary object of this invention to provide an improved metal anode assembly.

Another object of the invention is to provide a metal anode design which improves the degree of contact between anode surface and flowing brine to expedite removal of gas bubbles from the anodic surface as soon as possible after formation.

Still another object of the invention is to provide a metal anode assembly which has improved stability and resists warping.

It is a further object of this invention to provide a metal anode assembly of simplified construction and improved durability.

Still another object of the invention is to provide a novel titanium-based anode assembly which facilitates application and recoating of the active anodic surface.

These and other objects of the invention will be apparent from the following detailed description thereof.

It has now been discovered that the foregoing objects of this invention are accomplished in a metal anode assembly comprised of a distributor having at least one anode post receiver positioned in the top thereof and having spider-like arms extending from each anode post receiver to the periphery of the anodic surface. The anodic surface is preferably a series of rigid, parallel, spaced-apart bars which are integrally cast with the distributor and then coated with at least one oxide of a platinum group metal. The novel anode assembly is easily fabricated by the integral casting and resists damage and distortion during operation and handling, such as during installation and removal for recoating purposes. Positioning the metal anode assembly in the cell with the rods parallel to the direction of flow of the brine enhances removal of gas bubbles from the anode as they form and promotes the maintenance of a relatively constant real current density.

Figure 1:
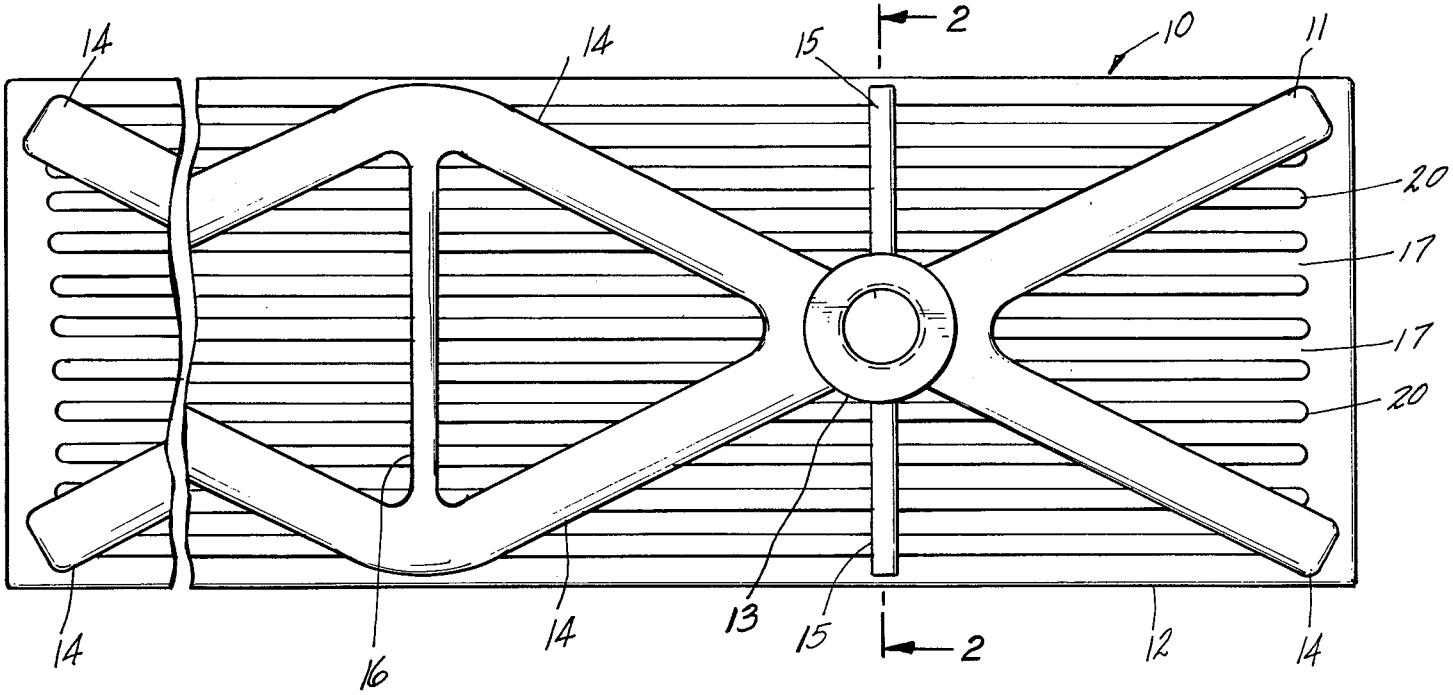
FIG. 1 is a partial view of a metal anode assembly illustrating this invention, having a spider-like distributor and anodic surface integrally cast with the distributor.
Figure 2:
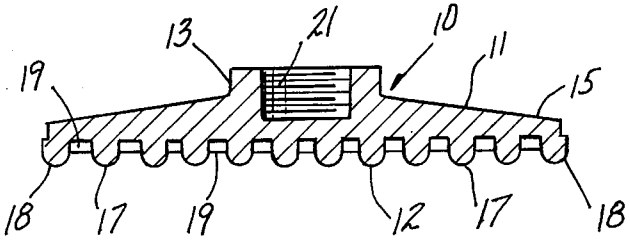
FIG. 2 is a cross sectional view of the metal anode assembly of FIG. 1 through lines 2—2.

More in detail, FIGS. 1 and 2 show metal anode assembly 10 comprised of a distributor 11 having an anodic surface 12 secured to the bottom thereof, and at least one anode support receiver 13 formed in the top thereof. Distributor 11, anodic surface 12 and anode support receiver 13 are all formed as a single integral casting of titanium. Anode support receiver 13 serves as an apex for the spider-like support ribs of distributor 11 such as diagonal support ribs 14 and transverse support ribs 15. Generally, for ease of handling metal anode assembly 10 has a length ranging from about 3 to about 5 feet and a width ranging from about 0.5 to about 2 feet, with two anode support receivers 13 per metal anode assembly 10. However, any convenient length, width and number of anode support receivers 13 may be employed.

Diagonal support ribs 14 and transverse support ribs 15 are preferably tapered downwardly from anode support receiver 13, (as shown in FIG. 2 for ribs 15) having a greater thickness or cross sectional area in the portion adjacent to anode support receiver 13 than the cross sectional area at the ends near attachment to anodic surface 12. Thus, it can be seen that each of said support ribs 14 have one end adjacent to and integrally cast with anode support receiver 13 and extending therefrom, with the opposite end of each support rib 14 being positioned at an extremity of anodic surface 12. Each support rib 14 tapers downwardly from the end adjacent to anode support receiver 13 to the opposite end. This tapering design is necessary to provide the most metal in the area of higher current and the least amount of metal in the area of lower current in order to maintain a substantially uniform current density across the active anodic surface described below.

Secured to the bottom of diagonal support ribs 14 and transverse support ribs 15, as an integral titanium casting with distributor 11 is anodic surface 12 comprised of a series of bars 17 which are parallel to each other and parallel to the longest side of metal anode assembly 10. Bars 17 have a curved surface 18 on the lower portion thereof and are positioned on distributor 11 in a manner which exposes curved surface 18 portion of bars 17 to the mercury cathode (not shown).

Bars 17 are spaced-apart a distance equivalent to the width of spacers 19 which are provided with a series of perforations 20. Bars 17 generally have a height and width each ranging from about ¼ inch to about 1 inch and preferably from about ⅜ inch and about ⅞ inch. The radius of curved surface 18 generally corresponds one-half of to the width of bar 17. The width of spacers 19 will vary with the size of bars 17, but generally range from about 1/16 inch to about ½ inch and preferably from about ⅛ inch to about ⅜ inch. The size of bars 17 and spacers 19 should be sufficient to provide adequate rigidity to inhibit distortion of bars 17 and permit casting of the metal anode assembly 10 with a minimum of defects.

Anodic surface 12 is activated for use in the electrolytic cell by coating bars 17 with at least one oxide of a platinum group metal, utilizing techniques known in the art, for example, as described in the above-identified Beer Patents.

Each anode support receiver 13 is provided with internal threads 21 to receive an anode support (not shown). If desired, internal threads 21 may be omitted and the anode supports may be friction welded or otherwise secured to anode support receiver 13.

After anode supports have been secured to metal anode assembly 10, it is installed in the mercury cell with bars 17 positioned parallel to the direction of brine flow. When current is passed through the cell to cause electrolysis of brine, chlorine gas bubbles form on curved surfaces 18 of bars 17, and the flowing brine sweeps the bubbles away from curved surfaces 18. The bubbles then pass up through perforations 20 to the upper portion of the cell (not shown) where they are collected and further processed. Although perforations 20 are shown in FIG. 1 as long continuous slots, one skilled in the art will recognize that the size of the slots may be reduced if desired. Since the flowing brine is directly in contact with a large proportion of the activated anode surface, large bubbles of chlorine are prevented from forming on the curved surface 18, the lower portion of bars 17, and as a result there is little or no change in the current density and cell voltage during cell operation.

Although the invention has been described and claimed in terms of titanium casting, one skilled in the art will recognize that all or part of the titanium may be replaced by tantalum, zirconium, columbium and mixtures thereof, and the claims to titanium cover such embodiments. Economically, titanium is the preferred metal used in casting the metal anode assembly.

Casting metal anode assemblies from titanium in accordance with this invention provides some significant advantages over prior art techniques, some of which have been mentioned above. In addition, cast titanium distributors may be formed with the desired degree of thickness in various sections to promote optimum current density without the need for excessive machining of parts. In order to maintain a substantially uniform current density on the anode surface, generally areas of high current near the anode support receiver utilize a greater proportion of metal, as relatively thick sections, while areas of low current near the ends of the spider-like ribs require relatively thin sections. This configuration is easily attained in the cast metal anode assembly of this invention. In addition, cast titanium distributors are formed with gas vents or perforations thereby eliminating the need for drilling holes in the distributor which results in a waste of a relatively expensive metal. Furthermore, integral casting of the anode support receiver in the distributor eliminates a source of leaks and offers lower resistence during cell operation. An additional advantage of the metal anode assembly of this invention is that the anode surface can be readily machined by milling or planing to form a smooth uniform surface for coating or recoating with an oxide of at least one platinum group metal. As a result, closer control of cell voltage can be obtained with the resulting activated metal anode assembly. Metal anode assemblies of this invention may be used to replace conventional graphite anodes or other metal anodes used in a wide variety of mercury cells. For example, the metal anode assembly of this invention may be used in mercury cells of the Olin, Krebs, and DeNora types.

Conventional techniques for casting titanium are employed in preparing the novel anode assembly of this invention.

One successful process for casting titanium is similar in some respects to the green sand process for making gray iron castings. Essentially, a granular mold material is rammed around a pattern of the casting to be made, the pattern is removed from the resulting mold, and liquid metal is poured into the cavity formed by the pattern.

Most titanium castings are made from patterns constructed for some other metal. The pattern is first altered if necessary to provide gates and risers suitable to meet the singular pouring and solidification characteristics of titanium. Some pattern surfaces require lagging to compensate for the shrinkage characteristic of titanium castings.

The mold material, with special advantage, is suitably high-purity graphite powder mixed with organic binders and water. The mold material is rammed around the pattern to form a mold, usually in two pieces. Any cores necessary to make cavities in the casting are also rammed in at this time. The patterns are removed from the molds and the molds are air-dried for several hours to remove free water slowly, avoiding cracks and warpage.

After air drying, the molds are dried for several hours at temperatures of about 250°F. to complete water removal.

The dried molds are fired at about 1600°F. in a reducing atmosphere to reduce the organic binder to carbon and to sinter the graphite. The resulting hard, dense mold is suitable to receive liquid titanium without reaction with the mold material. The molds are fired by loading the molds, each supported on flat machined graphite plates, into steel boxes, covering the molds with dry granular graphite to establish a reducing atmosphere, and then loading the whole into an air atmosphere furnace for a 24-hour soak. After the firing cycle is completed and the box has cooled, the molds are unloaded and are ready for assembly.

For castings weighing under about 75 pounds, most molds are assembled on a turntable and centrifuged in the casting furnace. Larger molds are set up for casting statically.

The molds to be cast and the casting electrode are loaded into the casting crucible. Atmospheric pressure in the furnace is reduced to about 20 microns of mercury and melting is begun. As melting progresses, the electrode shortens and it is progressively lowered into the crucible. Melting power is sufficient to maintain a pool of molten metal. When sufficient molten metal has collected, power is cut off and the crucible is tipped to pour the molten metal into the molds.

After the casting setup has cooled for about one hour, it is removed from the furnace and the molds are removed. Graphite from the molds is ground for re-use. Gates and risers are removed from the castings by torch cutting, abrasive sawing or grinding and the casting, with a minimum of finishing and waste is ready to use in the metal anode assembly.

The following example is provided to define the invention more fully. All parts and percentages are by weight unless otherwise specified.

EXAMPLE 1

A titanium casting is prepared corresponding to the metal anode assembly of FIGS. 1 and 2, wherein the distributor 11 is integrally cast with anodic surface 12 and anode support receiver 13. Anodic surface 12 has a length of about 48 inches and a width of about 9 inches. About 12 inches from each end of the distributor is placed an anode support receiver 13 having an outside diameter of about 2-⅛ inches and an interior threaded diameter of about 1-¼ inches. The overall height of the metal anode assembly is about 1-¾ inches. Four diagonal support ribs 14 extended from each central anode support receiver for a distance of about 1 inch. Diagonal support ribs each has a width of about 1 inch and form an angle of about 36½° with each other at the apex of the central anode support receiver. Transverse support ribs 15, each about ½ inch wide, are positioned to bisect each central anode support receiver 13 and divider 16, also having a width of about ½ inch, bisects the anode at the junction of the ends of the four central diagonal support ribs 14.

Anodic surface 12 is comprised of approximately 12 bars each having a semi-circular lower portion and having a width of about ½ inch. The space between each bar is about ¼ inch. Approximately 1 inch from each end of the anode surface, longitudinal perforations or slots are placed in the anodic surface parallel to and between each bar to provide space for the passage of chlorine gas from the effective anode surface to the top of the cell where chlorine is collected.

Metal anode assemblies of this design are placed in an electrolytic cell of the type described in U.S. Pat. No. 3,574,073, as a substitute for graphite anodes. Extensive operation of the cell to produce chlorine and caustic is accomplished without the need to replace the anodes and with a minimum of contamination of the brine with graphite particles.

What is claimed is:

1. In a metal anode assembly for electrolysis of flowing brine in an electrolytic mercury cell, wherein said metal anode assembly is comprised of a. a distributor, b. at least one anode support receiver positioned in the top of said distributor, c. an anodic surface in electric contact with and positioned below said distributor, d. said anodic surface is activated by applying a coating of an oxide of at least one platinum group metal, the improvement which comprises 1. employing as said distributor a spider-like distributor having a plurality of support ribs,
2. employing as said metal anode assembly an integral titanium casting comprised of
   a. said distributor,
   b. said anodic surface,
   c. said anode support receiver,
3. said anodic surface having a first set of two opposite sides longer than the remaining set of two opposite sides,
4. said anodic surface being formed of a series of spaced-apart bars parallel to said first set of opposite sides and
5. said metal anode assembly being adapted for positioning in said cell with said spaced-apart bars parallel to the direction of flow of said brine.

2. The metal anode assembly of claim 1 wherein the lower portion of said spaced apart bars is curved.

3. The metal anode assembly of claim 2 wherein perforations are positioned in said anodic surface between said spaced apart bars.

4. The metal anode assembly of claim 3 wherein said anodic surface is coated with a mixture of ruthenium oxide and titanium oxide.

5. The metal anode assembly of claim 4 wherein each of said support ribs have one end adjacent to and integrally cast with said anode support receiver and extending therefrom with the opposite end of said support rib being positioned at an extremity of said anodic surface, wherein said support rib tapers downwardly from the end adjacent to said anode support receiver to said opposite end.

6. The metal anode assembly of claim 1 wherein said anodic surface is a series of spaced-apart bars substantially parallel to each other.

* * * * *